United States Patent [19]

Seko et al.

[11] Patent Number: 4,955,176

[45] Date of Patent: Sep. 11, 1990

[54] VACANT PACKAGE-PROOFING CONTROL DEVICE FOR PACKAGING MACHINE

[75] Inventors: Kiyoshi Seko; Masato Hatano; Shigeki Suzuki, all of Nagoya, Japan

[73] Assignee: Fuji Machinery Company Ltd., Aichi, Japan

[21] Appl. No.: 267,944

[22] Filed: Nov. 7, 1988

[30] Foreign Application Priority Data

Apr. 7, 1988 [JP] Japan ..... 63-86583

[51] Int. Cl.[5] ..... B65B 57/10; B65B 11/10

[52] U.S. Cl. ..... 53/73; 53/55; 53/550

[58] Field of Search ..... 53/73, 55, 450, 550, 53/548, 494, 493, 498, 500

[56] References Cited

U.S. PATENT DOCUMENTS

| | | | |
|---|---|---|---|
| 2,934,869 | 5/1960 | Engleson et al. | 53/73 X |
| 3,269,085 | 8/1966 | Czajkowski | 53/73 |
| 3,451,188 | 6/1969 | Luginbühl et al. | 53/73 |
| 4,525,977 | 7/1985 | Matt | 53/55 |

*Primary Examiner*—James F. Coan

*Attorney, Agent, or Firm*—Schwartz & Weinrieb

[57] ABSTRACT

A vacant package-proofing control device for use in conenction with a packaging machine includes a first motor for driving a conveyor for feeding articles to be packaged, with a predetermined spaced defined therebetween, and a second motor for driving a series of rolls which deliver packaging material, formed into a tube, into which the articles are to be inserted for packaging. A third motor is also provided for driving a pair of end-sealing mechanisms. An absence detecting sensor is disposed at a predetermined position upstream of the end-sealing mechanisms for detecting the absence of any packaging article from its predetermined position upon its conveyor. A reference timing pulse generator is also provided for generating predetermined reference timing pulses in connection with the timing of the feeding of the packaging articles. When an absence detection signal from the absence detecting sensor coincides with a timing signal from the reference timing pulse generator, the motor drives for the packaging material and the end sealing mechanisms are gradually decelerated and stopped so as to prevent the formation of an empty package, and after a predetermined duration of time corresponding to the number of absent packages detected, the motor drives are gradually accelerated so as to sychronize the same with the drive motor for the article conveyor.

8 Claims, 10 Drawing Sheets

( In case of low-speed operation, 60 packages/min. ; cycle time : 1 sec. ; absence of two packaging articles )

VACANT PACKAGE-PROOFING CONTROL DEVICE FOR PACKAGING MACHINE

FIELD OF THE INVENTION

The present invention relates to a vacant package-proofing control device which can suitably prevent the formation of vacant packages (packages containing no articles to be packaged) when the feeding of packaging articles (articles to be packaged) to a bag-making/packing/packaging machine is interrupted separately or successively.

BACKGROUND OF THE INVENTION

There has been widely known a horizontal bag-making/packing/ packaging machine in which, while packaging articles are successively fed into a packaging material such as, for example, a film and the like being fed out horizontally into the form of a tube through means of a bag-making device, the longitudinal end portions of the tubular packaging material containing the packaging articles are subjected to lengthwise sealing of the overlapping faces thereof, followed by crosswise sealing and cutting of the tubular packaging material upon both sides of each packaging article so as to successively produce oblong pillow type packages. In this connection, the above longitudinal sealing is generally referred to as "center sealing"; whereas the crosswise sealing is generally referred to as "end sealing", and these latter mentioned terms will be used hereinafter, respectively.

The horizontal bag-making/packing/packaging machine mentioned above has various types of working mechanisms such as, for example, a conveyor for feeding packaging articles, feed rolls for delivering a packaging material, rolls for achieving center-sealing, sealers for achieving end-sealing for the packaging material, and others. The driving system of the conventional packaging machine described above has one main motor as a common driving source and is designed to drive a plurality of the working mechanisms mentioned above in connection with one another through means of mechanical power transmission systems, respectively, using this motor.

The feeding of the packaging articles to the above bagmaking /packing/packaging machine is generally achieved by forwarding them at a predetermined speed as a result of being engaged with an endless chain of the above conveyor having engagement attachments which are disposed thereon with a predetermined spacing defined therebetween. Accordingly, if it should happen that packaging articles are not supplied to any one of the corresponding attachments of the conveyor for some reason, then feeding of the packaging articles to the tubular packaging material formed within the packaging machine is temporarily interrupted so as to result in an absence of a packaging article (there may also be considered a case when such absence occurs separately and when two or more absences occur in succession). If such an absence of a packaging article should occur, a "vacant package" containing no packaging article will be present among the intact packages to be successively formed by means of the packaging machine. The formation of such vacant packages will not only lead to a waste of the packaging material but also involves inconveniences in that a special device for separating and removing them from among the intact packages is required. Therefore, when there is any absence of a packaging article within the row of the packaging articles transported upon the conveyor, it is necessary to institute procedures for preventing the formation of such vacant packages.

Accordingly, within a conventional packaging machine having a purely mechanical construction, procedures are used to detect the absence of a packaging article by means of a photoelectric tube and the like within the row of the packaging articles fed with a predetermined spacing therebetween upon the feed conveyor and for stopping the film delivering mechanism and the endsealing mechanism based upon such detection. For example, as disclosed in Japanese Utility Model Publication No. 10277/1975, there has been employed a system wherein a detection section for detecting the absence of packaging articles is disposed within the feed path of the feed conveyor; and a clutch which is actuated by means of a signal from this detection section is disposed for the respective driving sections of the packaging sheet delivering mechanism and the rotary sealing mechanism, so that the packaging sheet delivering mechanism and the rotary sealing mechanism may be stopped by actuation of the clutches during the absence of packaging articles upon the feed conveyor.

However, in the packaging machine having the above construction, substantial mechanical shock will be produced when the packaging sheet delivering mechanism and the rotary sealing mechanism are stopped or started as a result of the actuation of clutches, and furthermore, the system suffers from the problem that it does not exhibit a high-speed response upon detection of any absence of a packaging article.

OBJECT OF THE INVENTION

This invention has been proposed in view of the above disadvantages inherent in the above bag-making-/packing/packaging machine and for resolving the same, and is also directed toward providing a vacant package-proofing control device for a bagmaking /packing/packaging machine which can conveniently prevent the formation of vacant packages whether the number of absences is one or a plurality of absences in succession.

SUMMARY OF THE INVENTION

For the purpose of overcoming the above problems and achieving the intended object, this invention provides a vacant package-proofing control device for a packaging machine having:

a motor for driving a conveyor for feeding articles to be packaged with a predetermined space therebetween into a packaging material which is delivered downstream and formed into a tube;

a motor for driving a series of rolls which deliver the packaging material being formed into the tube; and a motor for driving a pair of sealers for achieving endsealing of the packaging material having been formed into the tube in the crosswise direction relative to the line of feed, characterized by the construction comprising:

an absence detecting sensor disposed at a predetermined position upstream of the point of transferring articles to be packaged from the conveyor for detecting the absence of packaging articles being transported upon the conveyor with a predetermined space defined therebetween;

a reference timing pulse generating means which generates predetermined reference timing pulses for the timing of the feeding of the packaging articles from the conveyor; and a means for stopping the motor for feeding the packaging material and the motor for achieving the end-sealing operation under gradual deceleration conditions, provided that coincidence of an absence detection signal from the absence detecting sensor and a timing signal from the reference timing pulse generating means should occur (AND condition), and after a duration wherein the motor drives are stopped for a number of cycles corresponding to the number of absent packaging articles, for starting the motor drives under gradual acceleration conditions until the speeds and phases thereof may be synchronized with those of the motor for driving the conveyor.

As has been described above, according to the vacant package-proofing device of this invention, each of the motors for delivering the packaging material and for achieving end-sealing is stopped under gradual deceleration conditions when there is any absence of packaging articles upon the conveyor and hence it is otherwise or conventionally expected in such state that vacant packages would normally be formed, and subsequently, the motor drives are started under gradual acceleration conditions at the point when the distance that the packaging articles which are successively fed has compensated for the number of absent packaging articles. Thus, formation of vacant packages can be effectively prevented. Moreover, since the sealers within the end-sealing mechanism are controlled so as to stop at positions completely separated from the packaging material, burning of the packaging material can effectively be prevented. Furthermore, while the above motors are gradually decelerated when they are to be stopped, they are gradually accelerated after they are started, whereby deviation of the packaging articles from their regular positions which may be caused by mechanical vibration and the like can be obviated even during high-speed operation.

Still further, when the motor for delivering the packaging material is in a pause mode, the pair of sealing means for achieving center-sealing automatically approach or are separated from each other in accordance with the timing to stop or start the feeding of the packaging material, whereby burning of the packaging material which may be caused during the process of closing or opening of the center-sealing rolls can also be prevented.

BRIEF DESCRIPTION OF THE DRAWINGS

Various other objects, features, and attendant advantages of the present invention will become more apparent from the following detailed description, when considered in connection with the accompanying drawings, in which like reference characters designate like or corresponding parts throughout the several views and wherein.

DETAILED DESCRIPTION OF THE INVENTION

Next, the vacant package-proofing control device for a packaging machine constructed according to this invention will be described below by means of a suitable embodiment referring while to the attached drawings.

(DRIVING SYSTEM FOR THE PACKAGING MACHINE)

Figure 10:
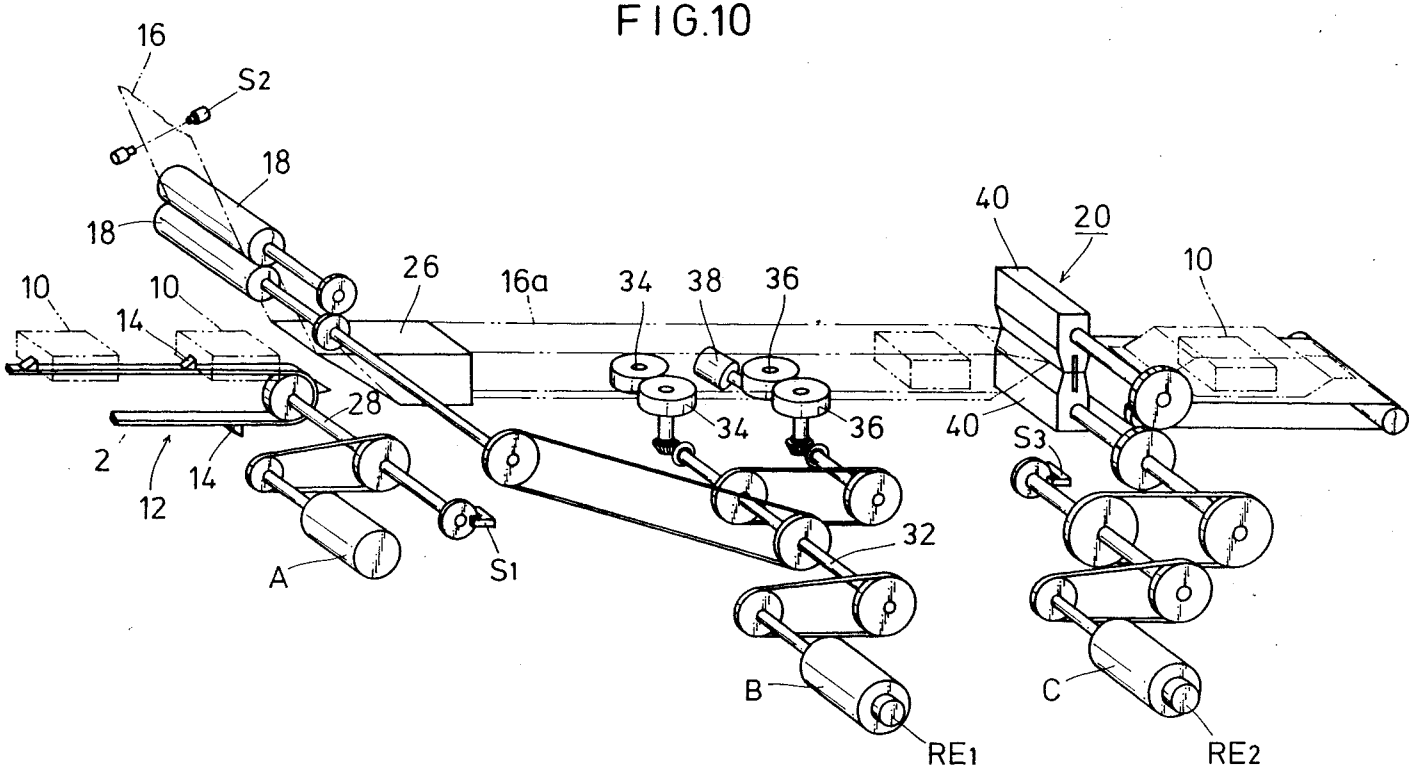
FIG. 10 is an illustration wherein the control device constructed according to this embodiment is employed within a triple motor-driven horizontal bag-making-/packing/packaging machine.

FIG. 10 shows an embodiment wherein the control device constructed according to this invention is employed within a triple motor-driven horizontal bag-making/packing/packaging machine. This packaging machine essentially comprises a motor A for driving a conveyor 12 for feeding packaging articles 10, a servomotor B for driving rolls (feed rolls) 18 for delivering a packaging material 16 and a servomotor C for driving an endsealing mechanism 20.

Figure 1:
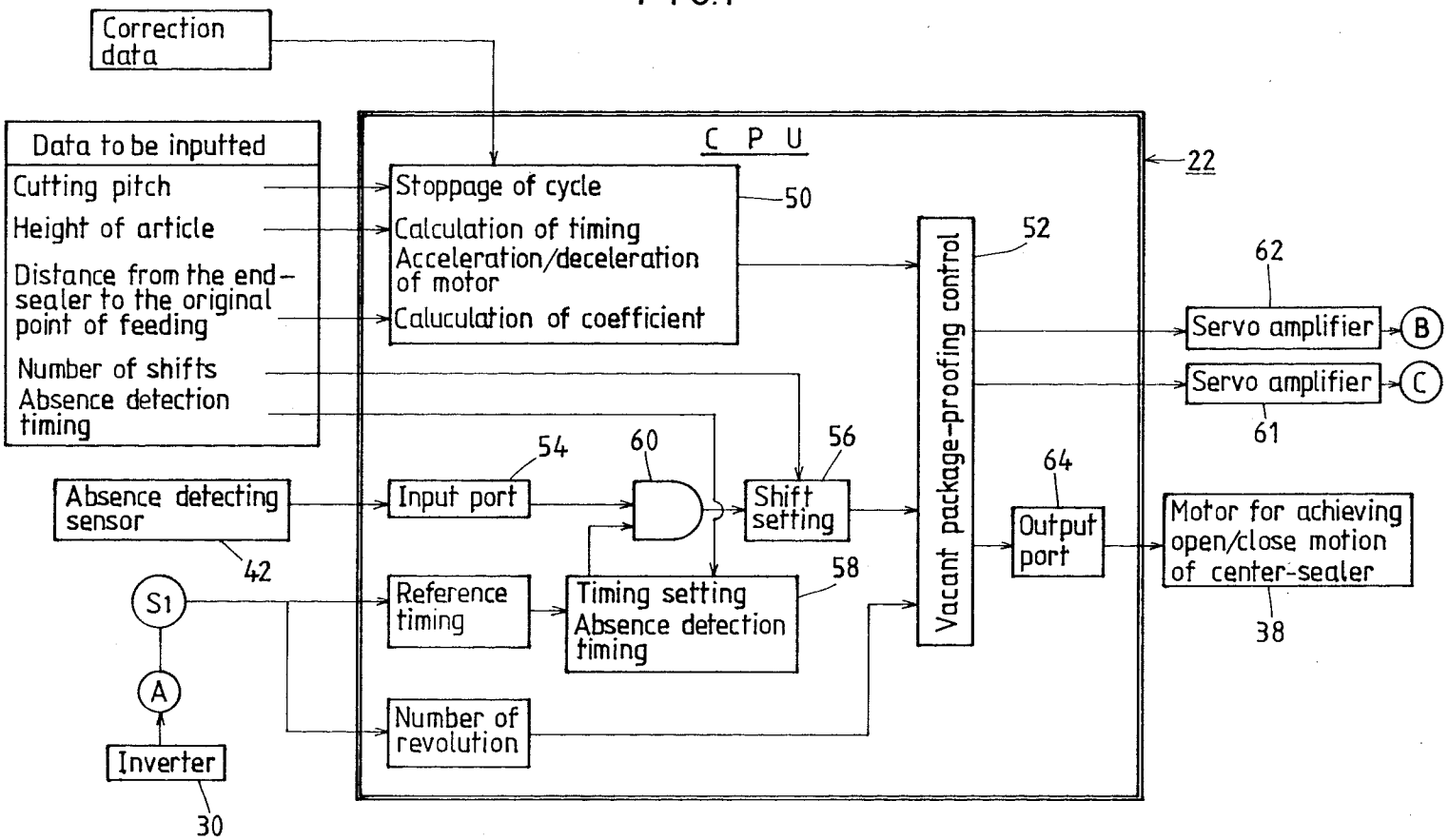
FIG. 1 is a block diagram of a control circuit to be employed within the vacant package-proofing control device constructed according to this invention.

The conveyor 12 is composed of an endless chain 24 and a plurality of attachments 14 fitted thereon with a predetermined spacing defined therebetween, so that the packaging articles 10 transported thereon by means of engagement with the attachments 14 may be fed into the packaging material 16 being formed into a tube through means of a bag-making device 26 disposed downstream of the conveyor. The conveyor 12 is driven by means of the motor A through means of a sprocket-chain transmission system provided in connection with a drive shaft 28 as shown in FIG. 10. The above motor A is, for example, an AC induction motor and it is controlled so as to be operated at variable speeds by means of a variable speed controller 30 such as, for example, an inverter as shown in FIG. 1 and the like.

A reference timing pulse generating means $S_1$ typified by means of a rotary encoder is provided for the above drive shaft 28. This reference timing pulse generating means $S_1$ generates pulses at predetermined reference timing for the times of the feeding of the packaging articles 10 from the feed conveyor 12, and the location of a packaging article 10 being transported upon the conveyor 12 can be determined by converting the number of pulses generated by the encoder into angular degrees.

The sheet-form packaging material 16 delivered from a feed source (not shown) comprising a roll of sheet material is supported between the above pair of feed rolls 18 so as to be delivered toward the bag-making device 26 disposed downstream from the conveyor 12. The packaging material 16 having been formed into a tubular bag **16*a* by means of this bag-making device 26 is fed downstream with the overlapping edge portions along the longitudinal end portions thereof being supported between a pair of feed rolls 34**.

Furthermore a pair of heat-sealing rolls 36 are engageably provided so that they may be engaged (closed) while the packaging material 16 is being fed so as to effect center-sealing of the above overlapped both end portions of the packaging material 16 by pressing the overlapped both end portions supported therebetween as they are fed. Incidentally, a motor 38 is provided as a drive source for achieving the open/close motion of these center-sealing rolls 36, and this motor 38 is controlled as will be described below so as to effect the supporting or releasing of the overlapped end portions of the material 16 by means of the two rolls 36. Alternatively, in place of the use of the above motor 38, an actuator such as, for example, a solenoid, a hydraulic cylinder, or the like can be employed so long as such corresponds to respective design specifications. Furthermore, in place of the illustrated center-sealing rolls 36, various types of sealing means, such as, for example, a belt-sealing means for supporting a portion to be sealed between a pair of rotating pressurized belts, or a slide nip-sealing means for press sealing a portion of the material to be sealed by means of a pair of nip rolls (unheated) as the portion of the material to be sealed is passed through a pair of heated bars or others, can be suitably employed if such means correspond to respective design specifications.

The above pair of feed rolls 18 are driven by means of the servomotor B through means of a belt-pulley transmission system as illustrated in FIG. 10. The power of the servomotor B is divided by means of a drive shaft 32 so as to synchronously drive the pair of feed rolls 34 and the heat-sealing rolls 36. The rotation of the servomotor B is constantly detected by means of a rotary encoder $RE_1$ so as to effect servo-actuated control of the servomotor B by feeding back the number of revolutions to the control circuit.

Continuing further, the sealers 40 rotatably disposed so as to oppose each other in a vertical relationship within the end-sealing mechanism 20 are driven by means of the servomotor C through means of a belt-pulley transmission system, and this servomotor C is designated so as to be controlled by means of a rotary encoder $RE_2$ for servo-actuated control. As the sealers 40, there may be suitably employed, in place of the rotary sealing mechanism constructed according to this embodiment, a so-called block motion system sealing mechanism in which sealers are moved horizontally and synchronously along the line of feeding of the tubular bag **16*a*, ascended so as to be spaced from the tubular bag 16*a*** and retracted horizontally from each other, and then descended again for horizontal motion.

Figure 2:
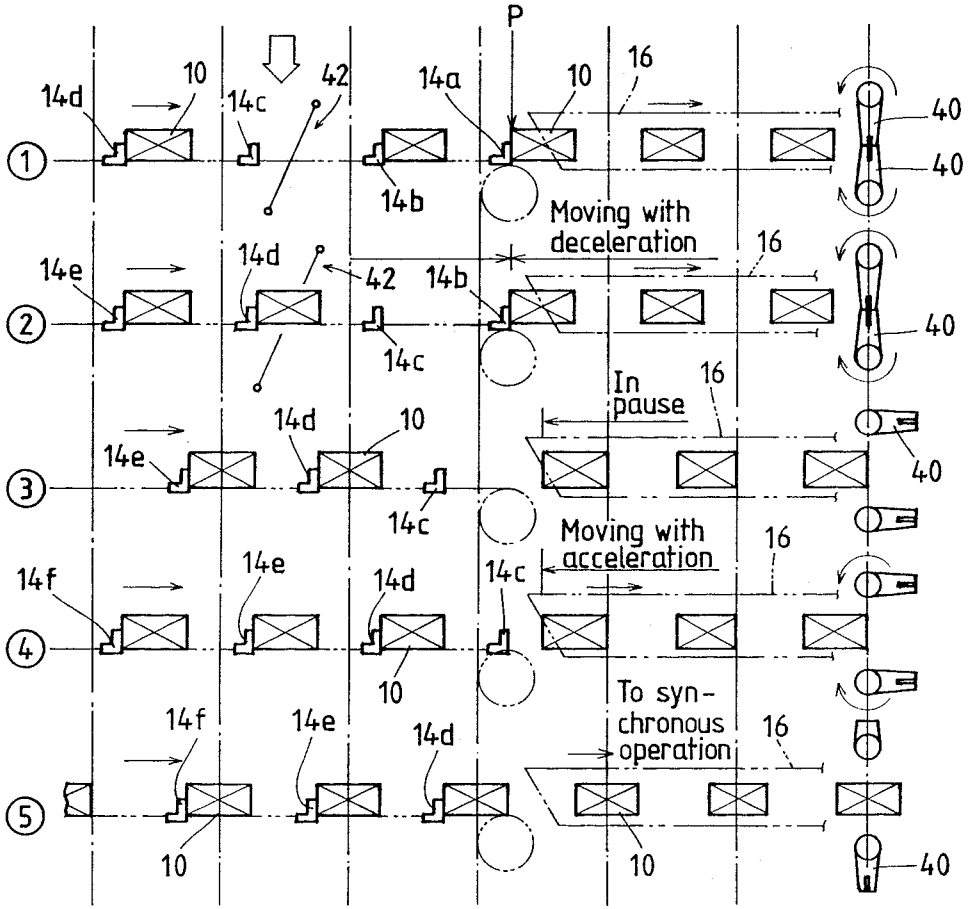
FIG. 2 is an illustration of the timing, with the passage of time, of the motions of the conveyor and the sealers with respect to the flow of the packaging material into which the articles to be packaged are inserted, when one packaging article is absent.
Figure 5:
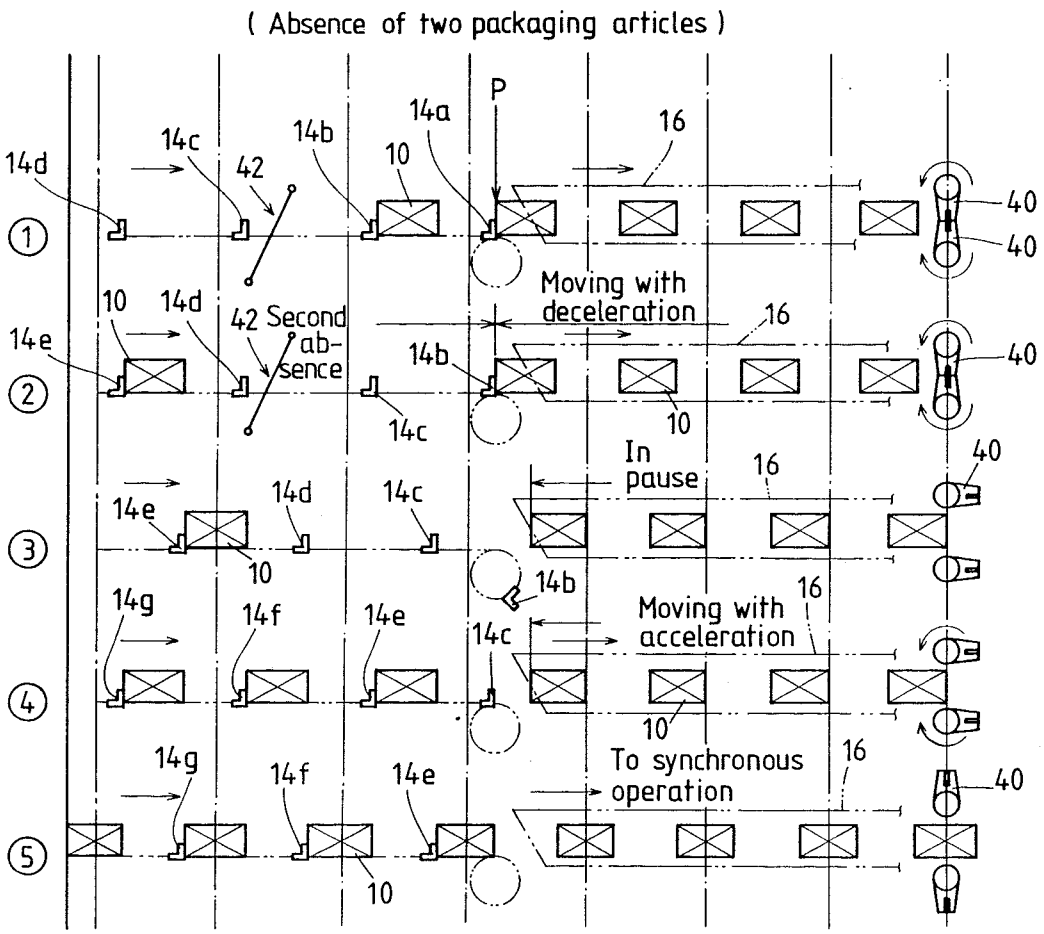
FIG. 5 is an illustration of the timing, with the passage of time, of the motions of the conveyor and the sealers with respect to the flow of the packaging material into which the articles to be packaged are inserted, when two packaging articles are absent.

As shown in FIGS. 2 and 5, a sensor for detecting the absence of packaging articles (absence detecting sensor) 42, such as, for example, comprising a light emitting-/receiving device, is disposed upstream of the point of delivering the packaging articles 10 from the conveyor 12, and is adapted to detect the absence of the packaging articles 10 to be forwarded upon the conveyor under as a result of engagement with the attachments 14, respectively. This absence detecting sensor 42 is disposed, for example, at a position shifted upstream from the original point of feeding the packaging articles from the conveyor 12, that is, at the position corresponding to the second attachment from the above original point of delivery and performs a detection operation for each of the packaging articles 10 passing the detection zone of the sensor 42. The sensor 42 detects any possible absence of the packaging article in the present cycle or in the cycle immediately preceding the present cycle and outputs a signal to a control circuit 22 to be described later. As will be described below in more detail, the control circuit 22 is designed to give a control command so as to stop the motors B and C under deceleration conditions after waiting for the number of shifts preliminary inputted at the position where the absence detecting sensor 42 is disposed with respect to the conveyor 12.

(CONTROL CIRCUIT)

FIG. 1 is schematic a block diagram of an exemplary control circuit to be employed within the vacant package-proofing control device constructed according to the embodiment of this invention. Various data are inputted from external sources into a central processing unit (CPU) in the control circuit 22, and commands based upon the results obtained after operational processing of these inputted data are adapted to be given to the motor B for feeding the packaging material 16, the motor C for achieving endsealing of the packages, and the motor 38 for achieving the open/close motion of the sealing rolls 36, respectively.

The control circuit 22 has an operational block 50 comprising an operational section for calculating the cycle stop time $Q_0$ and an operational section for calculating the gradual acceleration/deceleration coefficient of the motors B and C, and data including (1) the cut pitch for cutting the packaging material 16, (2) the height of the packaging article 10, and (3) the distance from the original point of feeding the packaging articles 10 into the tubular bag **16*a* into the sealers 40 are inputted to this operational block 50 by means of an external inputting means such as, for example, a keyboard, or the like, and the resulting calculated output is inputted into a vacant package-proofing control block 52. The term "acceleration/ deceleration coefficient of the motor" used herein is intended to mean the degree of smoothness in the operation of the motor when it is accelerated or decelerated (that is, the degree to which the motor rotates slowly or rapidly), which is defined by means of a coefficient of, for example, 1 to 9. Accordingly, if the coefficient of the motor is set at 5, the deceleration for stopping the motors B and C or for starting the same with acceleration will be achieved within the range of 180 [360 (a full rotation of the reference timing pulse generating means $S_1$) $\times 5/10$]. In addition, each of the above sealers 40 makes a revolution which corresponds to ½ the rotation of the reference timing pulse generating means $S_1$, that is, a rotation of only 90 as a result of the decelerated stopping or accelerated starting of the motor C, depending upon the above condition. The rotational angle of the reference timing pulse generating means $S_1$ with respect to those of the sealers 40 is such as to constantly maintain a ration of ½. Incidentally, the acceleration/deceleration coefficient of the motors B and C and the cycle stop time $Q_o$ are adapted to be inputted into the above operational block 50**, as necessary, as correction data.

Absence detection signals from the absence detecting sensor 42 are inputted through means of an input port 54 to one of the inputting sections of an AND circuit 60; whereas the reference timing pulses and the number of revolutions of the conveyor 12 are separately derived from the pulse signals from the reference timing pulse generating means $S_1$, and the former number of timing pulses is inputted into a timing setting section 58 together with the absence detection reference timing (absence detection timing) signals to be inputted by means of a keyboard and the like. The latter number of revolutions are directly inputted into the vacant package-proofing control block 52. The timing setting section 58 inputs deviation timing signals inputted by means of the keyboard and based upon the reference timing signals from the reference timing signal generating means $S_1$ into the other inputting section of the AND circuit 60. From this AND circuit 60, "absence detection" signals are inputted into a shift setting means 56, based upon the AND provision that the absence detection signal from the absence detecting sensor 42 coincides with the absence detection timing signal to be inputted from the timing setting section 58.

Into this shift setting means 56, the number of shifts to be defined by means of a keyboard and the like is inputted, and upon receipt of the "absence detection" signal from the AND circuit 60, the shift setting means 56 is allowed to wait for a predetermined period based upon the required number of shifts and then outputs a command signal to the vacant package-proofing control block 52.

Thus, the vacant package-proofing control block 52 gives control commands to the motor B for feeding the packaging material 16 and the motor C for achieving the end-sealing operation through means of servo amplifiers 61 and 62, respectively, so as to stop under gradual deceleration conditions or to start under gradual acceleration conditions, and also gives commands of disengagement (opening) and commands of engagement (closing) through means of an output port 64 to the motor 38 for achieving the open/close movement of the sealing rolls 36.

Next, the function of the vacant package-proofing control device constructed according to the embodiment of this invention having the aforenoted components will be described. In connection with undesired formation of vacant packages mentioned above, there are cases when such an absence of the packaging articles 10 being forwarded upon the conveyor as a result of engagement with the attachments 14 occurs singly or alternatively, two or more of such absences of packaging articles 10 may occur in succession. Therefore, a description will be made with respect to the respective cases.

FIG. 2 shows an illustration of a timing scheme with the passage of time of the motions of the conveyor 12 and the sealers 40 with respect to the flow of the packaging material 16 into which the packaging articles 10 in the direction indicated by means of the arrow are inserted when there is an absence of one packaging article; wherein the attachments 14 attached with a predetermined space defined therebetween and upon the feed conveyor 12 are designed to push corresponding packaging articles 10 in the forward direction indicated by means of the arrow and feed them one by one into the packaging material 16 which is fed downstream at a predetermined speed so as to be formed into a tube. The absence detecting sensor 42 is disposed at a position shifted at least toward the position of the second attachment upstream from the point of transferring the packaging articles 10 from the feed conveyor 12, so as to constantly monitor the absence of packaging articles 10 passing by the detection zone of the sensor 42. On the other hand, the reference timing pulse generating means $S_1$ continuously generates pulses as a necessary reference time frame during the time of feeding the packaging articles 10 from the conveyor 12 for feeding packaging articles to be driven by means of the motor A, so as to output them to the timing setting section 58 as shown in FIG. 1.

In Step 1 of FIG. 2, when the third attachment **14*c* upstream from the point P at which the packaging articles 10 are transferred from the conveyor 12 appears having no packaging article 10 engaged therewith, that is, in an article-free state, the above sensor 42 detects this absence and inputs an absence detection signal to the above input port 54 of the control circuit 22. The above timing setting section 58 generates one timing pulse as an absence detection timing signal based upon the absence detecting timing to be inputted by means of a keyboard and the like per one rotation (360°) of the rotary encoder constituting the reference timing pulse generating means $S_1$. This pulse agrees with the rising pulse which is an "article presence" signal to be outputted by means of the absence detecting sensor 42 as shown in the timing chart of FIG. 8. In this regard, the intervals between the rising pulses outputted from the absence detecting sensor 42 can be regarded as one cycle for feeding the packaging articles 10 being successively forwarded as a result of engagement with the corresponding attachments 14**.

If coincidence of the absence detection signal ("no packaging article") from the absence detecting sensor 42 and the absence detection timing signal from the timing setting section 58 should occur within the AND circuit 60 shown in FIG. 1 in accordance with the AND provision, the vacant package-proofing control block 52 gives a deceleration command to the motor B for feeding packaging material 16 and the motor C for achieving endsealing, and both motors B and C are stopped under gradual deceleration considerations. However, as will be described later referring to FIG. 9, the above sensor 42 is not only designed to immediately stop the two motors B and C under gradual deceleration conditions so as to stop the feeding of the packaging material 16 and the movement of the sealers 40 under gradual deceleration conditions upon identification of the absence of a packaging article, but the sensor 42 also determines whether or not a packaging article 10 is forwarded by means of the following fourth attachment **14*d***.

In Step 2 of FIG. 2, when the absence detecting sensor 42 detects the presence of the packaging article 10 in engagement with the fourth attachment **14*d*, the two motors B and C are controlled so as to begin deceleration after waiting until the present location $Q_1$ of the packaging article being fed is known as a result of the reference timing pulse generating means $S_1$ being in agreement with the cycle stop timing $Q_o$ as will be described later referring to the flow chart of FIG. 9. Accordingly, the packaging material 16 under feeding by the motor B and formed into a tube through means of the bag-making device 26 is forwarded at normal speed until the packaging article 10 forwarded by means of engagement with the second attachment 14*b* (the one preceding the attachment 14*c*** in which the packaging article is absent) is fed into the packaging material at the point of transfer P.

As shown in Step 3 of FIG. 2 and in FIG. 3 (to be described later), a control is achieved for beginning deceleration of the motor B for delivering the packaging material 16 so as to stop it when it has made a 180° turn in terms of an angular conversion of the encoder $S_1$. The motor C for driving the sealers 40 is also controlled so as to begin deceleration in order to stop at the point when the sealers 40 have reached the positions where they are free from contact with the tubular packaging material 16 as a result of the 180° turning thereof in terms of an angular conversion of the encoder $S_1$, that is, where the sealers 40 have made a 90° turn from their positions of engagement. (In the present specification, the above control is achieved when the cycle stop time $Q_o$ has been set to be at the position of engagement of the sealers 40 and the original point P of transferring the packaging article 10 from the conveyor 12, provided that the acceleration/deceleration coefficient described above has conveniently been set at 5. In such a situation, although the sealers 40 are controlled so as to stop at the point where they have made a 180° turn in terms of an angular conversion of the encoder in the reference timing pulse generating means $S_1$, which corresponds to ½ cycle, the rotation angle of the sealers 40 themselves will be only 90° because of the decelerated stopping.)

It should be noted that the stop angle of the sealers 40 to be achieved as a result of the decelerated stopping will automatically be set to be at positions such that they may be free from contact with the above tubular packaging material 16, since the preset values of the above acceleration/deceleration coefficient and the cycle stop time $Q_o$ are calculated from the inputted data to be inputted by means of a keyboard and the like including the cut pitch for cutting the packaging material 16, the height of the article, and the like, whereby contact between the sealers 40 with the packaging material 16 can be obviated when the sealers 40 are decelerated for stopping so as to prevent undesired burning of the packaging material 16. Furthermore, the above conveyor 12 is operated at a steady state speed and phase irrespective of the decelerated stopping of or accelerated starting the above motors B and C.

Next, as shown in Step 4 of FIG. 2, when the packaging article 10 engaged with the fourth attachment **14*d* compensates for the previous absent pitch formed by means of the third attachment 14*c*, that is, when the present location $Q_1$ of the packaging article 10 being fed is synchronized with the cycle stop time $Q_o$, the two motors B and C which have been stopped or paused are controlled so as to be started under gradual acceleration conditions. After gradual acceleration of the motors B and C until the speeds and phases thereof may be synchronized with the steady state speed and phase of the motor A for driving the conveyor 12**, they are continued to be operated at the steady state speed, respectively.

As has been described heretofore, according to the device of this embodiment, the motor B for delivering the packaging material 16 and the motor C for driving the sealers 40, after they are allowed to wait (be shifted) until the present location $Q_1$ of the packaging article 10 being fed agrees with the cycle stop time $Q_o$, are stopped under gradual deceleration conditions. After a predetermined stopping period, the motors B and C are started under gradual acceleration conditions. Namely, the motors B and C do not make any abrupt stop or start, if any absence of packaging articles 10 should be detected, so that neither vibration nor shock may suddenly be generated within the system itself whereby deviation of the packaging article 10 can effectively be prevented. Moreover, since the sealers 40 are controlled so as to be disposed at positions where they are completely free from contact with the packaging material 16 when they are stopped, burning of the packaging material 16, normally caused by the contact with the sealers 40 can be advantageously and effectively prevented.

FIG. 5 illustrates, with the passage of time, the timing of the movements of the conveyor 12 and the sealers 40 with respect to the flow of the packaging material 16 into which the packaging articles 10 are inserted, when two packaging articles are absent. In such a situation, as shown in Steps 1 and 2 of FIG. 5, the absence detecting sensor 42 first detects an absence in connection with the third attachment **14*c* and a second absence in connection with the fourth attachment 14*d*, respectively. Upon detection of the absence of two packaging articles 10 in succession, the two motors B and C are allowed to begin deceleration after waiting until the present location $Q_1$ of the packaging article 10 being fed is synchronized with the cycle stop time $Q_o$. Incidentally, the feed conveyor 12 is operated at a steady state speed even after the stopping of the two motors B and C, and acceleration of these motors B and C is started when the absence of the two preceding packaging articles has been compensated for by means of the packaging article in engagement with the fifth attachment 14*e*, that is, when the present location $Q_1$ of the packaging article 10 being fed agrees with the cycle stop time $Q_o$. Upon synchronization of the speeds and phases of the two motors B and C with those of the motor A for driving the feed conveyor 12**, the above control is completed.

(OPEN/CLOSE CONTROL OF SEALING ROLLS)

Now, in the packaging machine constructed according to the embodiment, the overlapping longitudinal end portions of the packaging material 16 are subjected to center-sealing by means of the rolls 36 as described above. In the above process, there remains a problem concerning the operation of the opening or closing of the sealing rolls 36 and how such should be controlled when the feeding of the packaging material 16 and the rotation of the sealers 40 are stopped upon identification of any absence of the packaging article 10. The reason is that if the sealing rolls 36 remain closed when feeding of the packaging material 16 is stopped upon detection of the occurrence of the absence of a packaging article, the packaging material 16 which is in contact with the rolls 36 will be melted or burned.

Accordingly, when the feeding of the packaging material 16 and the rotation of the sealers 40 are stopped upon detection of any absence of a packaging article 10, the center-sealing rolls 36 should also be positively disengaged so as to be spaced from the packaging material 16.

However, due to the time lag generated in connection with the movements of the closing and opening of the sealing rolls 36, if the opening or closing process respectively requires, for example, 0.2 second, a mechanical difficulty occurs in that the above speed may be too slow to follow the stop/start cycle of the two motors B and C for a packaging machine which is operated during a high speed cycle. Thus, in the present embodiment, a control is achieved wherein the open/close movement of the rolls 36 is performed only when the timing of the closing of the sealing rolls 36 is delayed relative to the timing of the opening of the sealing rolls 36, otherwise no open/close movement of the sealing rolls 36 is performed.

Figure 3:
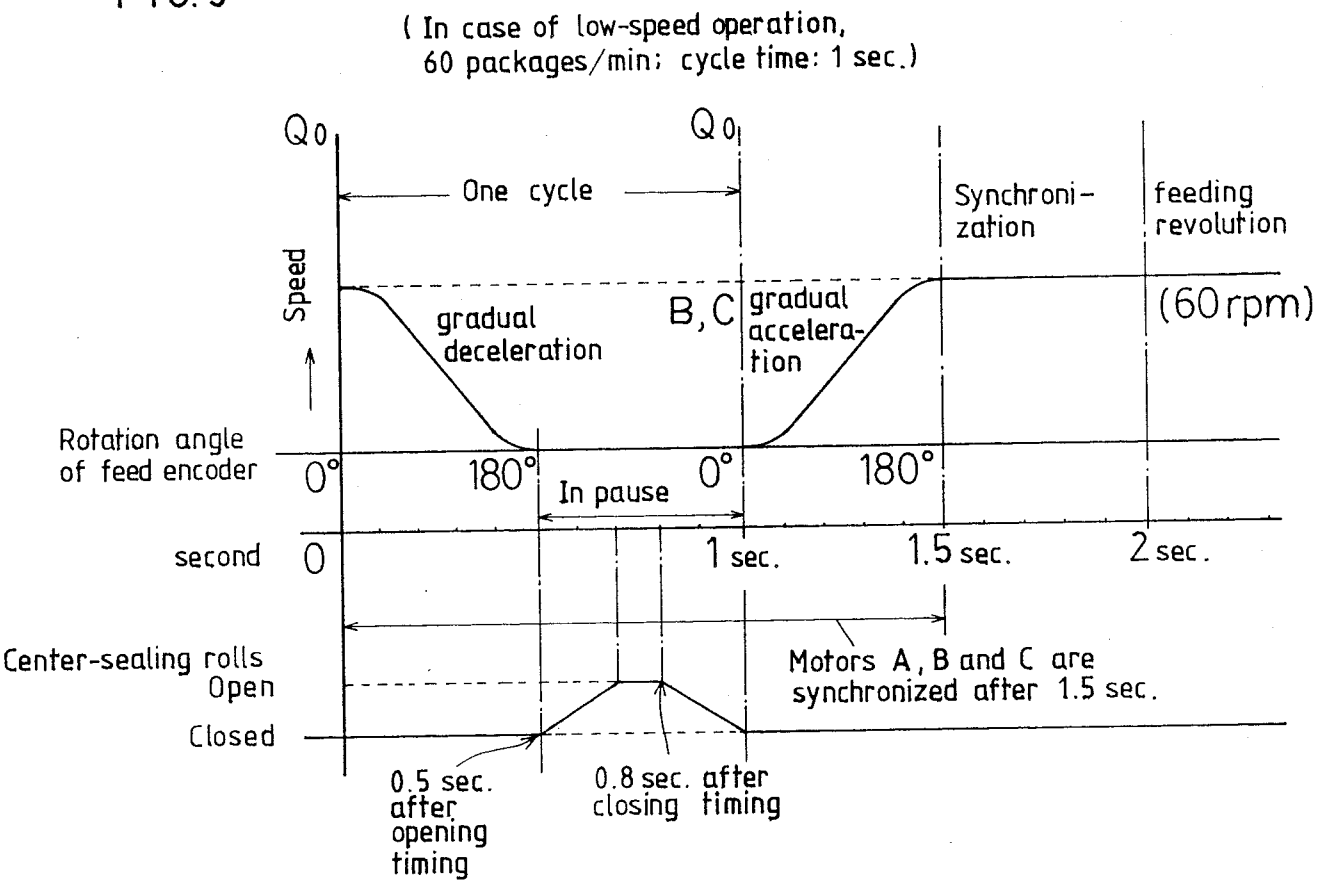
FIGS. 3 and 4 are graphic illustrations of the relationship between the number of revolutions of the packaging machine and the open/close timing of the sealing rolls when one packaging article is absent.
Figure 4:
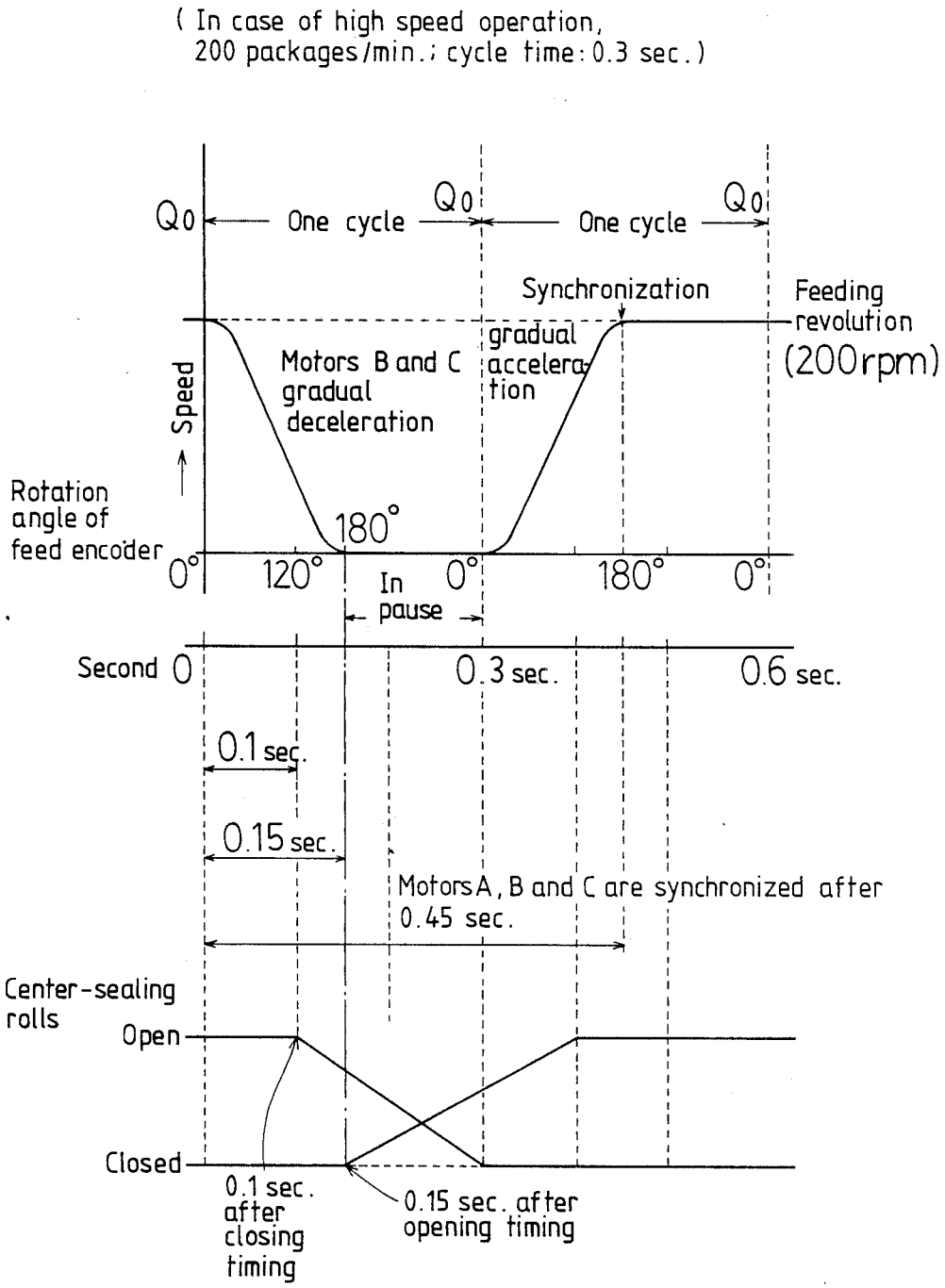

FIGS. 3 and 4 each show a graphic illustration of the relationship between the operation of the packaging machine and the open/close timing of the sealing rolls 36 when there is an absence of one packaging article; wherein FIG. 3 shows the condition when the packaging machine is operable at a relatively low speed; whereas FIG. 4 shows the condition when the packaging machine is operable at a relatively high speed. Now, referring first to FIG. 3, there is shown an example when the packaging machine has a low speed operation of 60 packages/minute (cycle time: 1 second), wherein the time to be required for closing the sealing rolls 36 is preset, for example, at 0.2 second as described above. As can be seen from the curve shown in FIG. 3, when the cycle stop time $Q_o$ is preset at 0° in terms of the angular conversion of the feeding encoder $S_1$, deceleration of the two motors B and C is gradually started from the beginning of the next cycle, that is, when the rotation angle of the encoder $S_1$ becomes 0°, upon detection of the absence of one packaging article, so as to stop at the positions where they have made an advance of 180° in terms of the angular conversion of the feed encoder $S_1$ that is, at the middle of one cycle.

This stopping state continues from the positions of 180° in terms of the angular conversion of the encoder $S_1$ to the next 0°, that is, from the end point of the present cycle to the beginning of the next cycle (cycle stop time $Q_o$), and upon initiation of the next cycle, gradual acceleration of the two motors B and C is commenced. In the next cycle, at the positions where they have made an advance of 180 in terms of the angular conversion of the feeding encoder $S_1$, the speeds and phases of the two motors B and C are synchronized with the revolution speed (60 rpm) and phase of the motor A for driving the conveyor 12 so as to resume steady state operation.

In this process, in view of the open/close timing of the sealing rolls 36, the opening time therefor is first set at 0.5 second after completion of the stopping of the above two motors B and C. After closing of the rolls 36 which requires 0.2 second as described above, and also at the point when the two motors B and C are restarted, the rolls 36 should be completely closed. Taking these time allowances into consideration, the two rolls 36 once having been opened should resume their closing motion 0.8 second after the stating of the cycle which is repeated every one second. Namely, since the timing of the opening of the two rolls 36 can precede the timing of closing them based upon the cycle stop time $Q_o$, opening and closing of the sealing rolls 36 are conveniently achieved while the two motors B and C are in their pause or stop state.

Therefore, as shown in FIG. 4, for example, when the operation of the packaging machine is as high as 200 packages/minute (cycle time: 0.3 second), the timing of the closing of the sealing rolls 36 can be found to be 0.1 second after starting the deceleration of the two motors B and C when calculated back based upon the cycle stop time $Q_o$.

On the other hand, it is 0.15 second after these motors B and C have advanced to the positions of 180 in terms of the rotation angle of the rotary encoder within the reference timing pulse generating means $S_1$ when they are stopped completely, and at the point after passage of this 0.15 second, the timer for opening the sealing rolls 36 is set. In this situation, since the closing time precedes the opening time, a control for insuring the open/close movement of the two rolls 36 is achieved. Namely, when the closing time can only be set during the process of the deceleration operation of the two motors B and C in determining the closing time to be discussed later while referring to FIG. 9 upon reading of the actual feed revolution of the feed conveyor 12 by means of the reference timing pulse generating means $S_1$, the two rolls 36 are adapted to perform no open/close movement.

Figure 6:
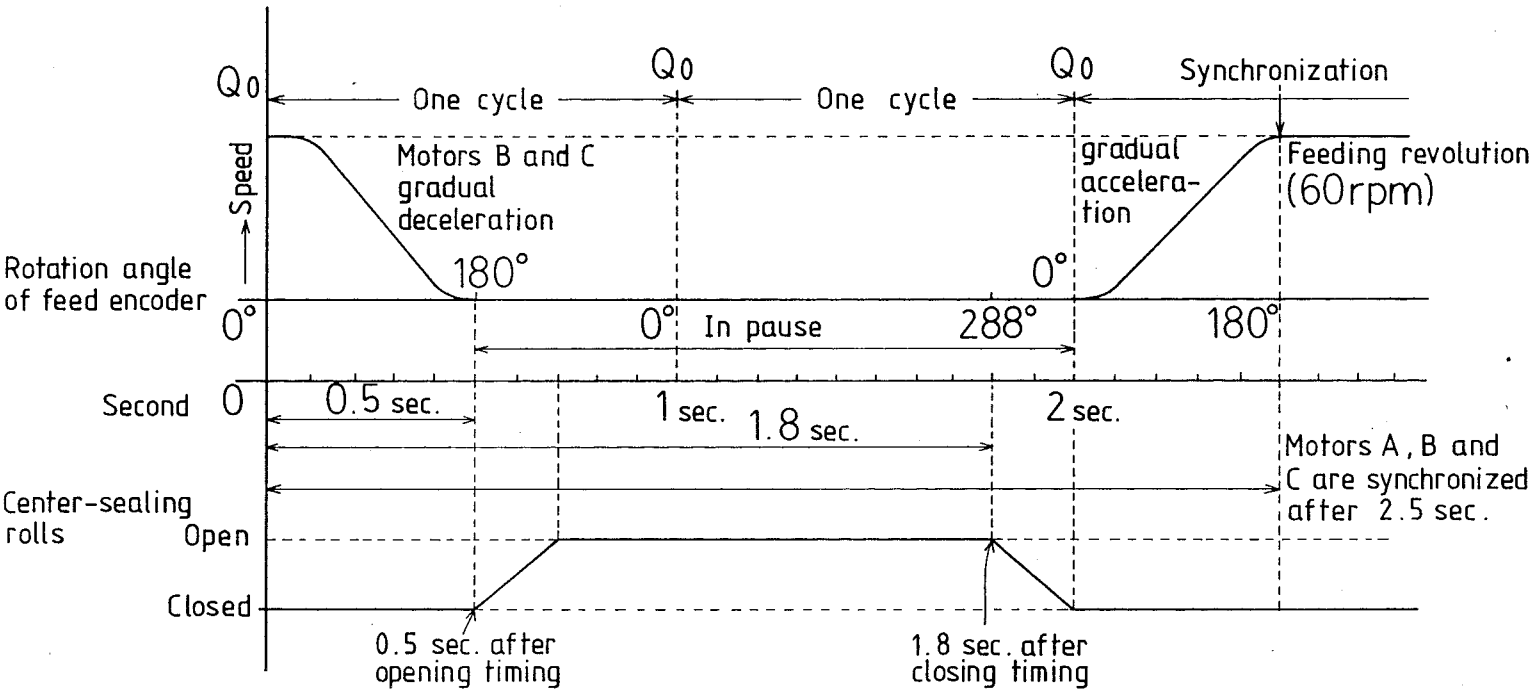
FIG. 6 is a graphic illustration of the relationship between the number of revolutions of the packaging machine and the open/close timing of the sealing rolls when two packaging articles are absent in succession.
Figure 7:
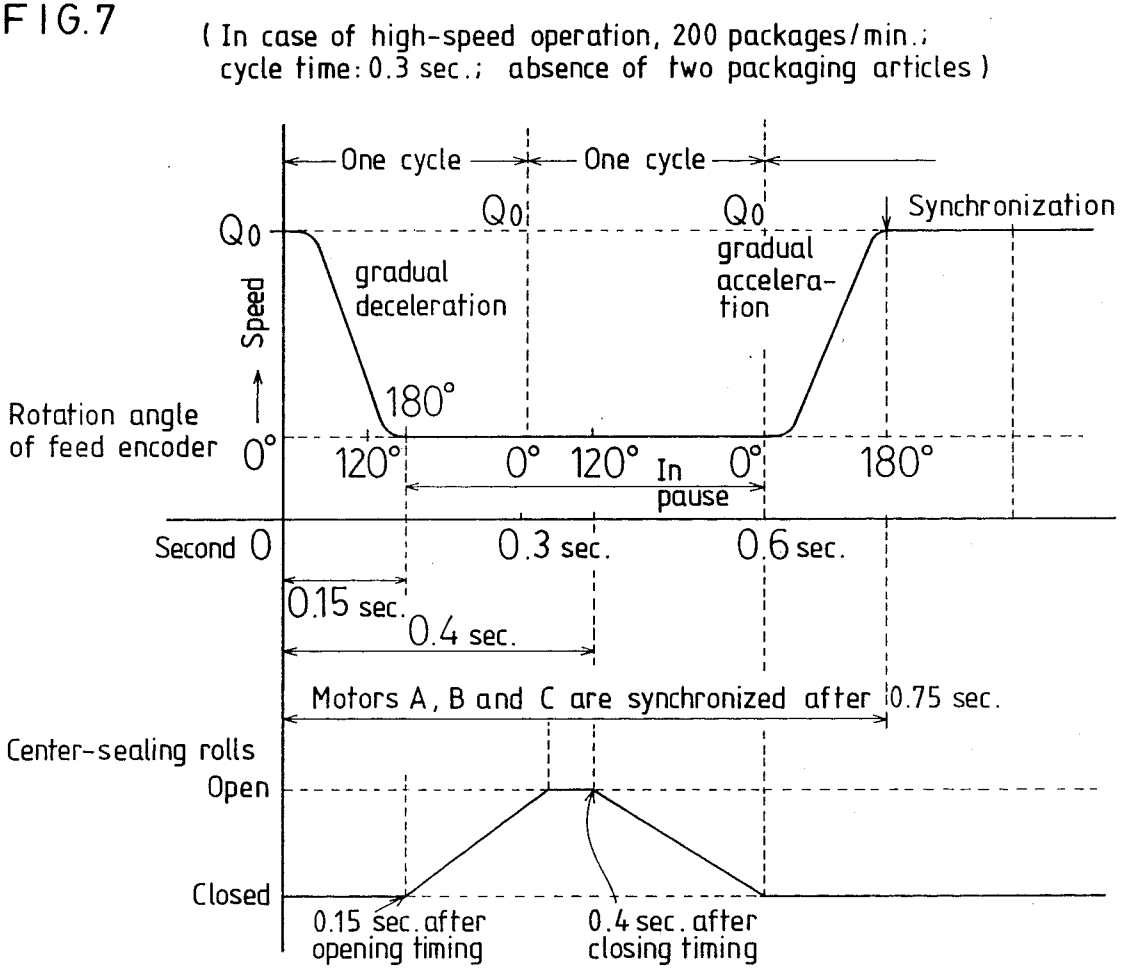
FIG. 7 is a graphic illustration of an example when the packaging machine is operated at a relatively high speed of revolution and wherein two packaging articles are absent in succession.

Next, in FIG. 6, a graphic illustration of the relationship between the operation of the packaging machine and the open/close timing of the sealing rolls 36 when there is an absence of two packaging articles in succession is shown, in which the operation of the packaging machine is relatively as low as 60 packages/minute (cycle time: 1 second) which is similar to the case shown in FIG. 3. FIG. 7 shows an example where the operation of the packaging machine is relatively as high as 200 packages/minute (cycle time: 0.3 second) which is similar to the case shown in FIG. 4.

The relationship described referring to FIG. 3 basically applies to the example shown in FIG. 6. However, because of the absence of two successive packaging articles, the motors B and C are stopped for an additional cycle, whereby the period to be preset and during which the center-sealing rolls 36 are kept open will be the longer. The time for closing the sealing rolls 36 will be set such that the sealing rolls 36 may start closing 0.2 second sooner with respect to the cycle stop time $Q_o$ which is the end of the second cycle. Accordingly, during such low speed operation, the open/close movement of the sealing rolls 36 can be achieved without any difficulty.

The relationship shown in FIG. 7 is basically the same in function as the one described referring to the above FIG. 4, except that there is a difference in the number of absences, that is, 1 or 2, and the motors B and C are controlled so as to stop for an additional cycle. Namely, the motors B and C, after starting their deceleration, stop when they have advanced to the positions of 180° in terms of an angular conversion of the encoder $S_1$ so as to be kept in the pause state for 0.15 second, and after a duration of this period the sealing rolls 36 are opened unconditionally.

On the other hand, the sealing rolls 36 are required to be closed completely after the passage of 0.6 second when the motors B and C are to be restarted. Accordingly, the timing of the closing of the rolls 36 is set to be at the point 0.4 second after starting the deceleration of the motors B and C, based upon the provision that the closing of the two rolls 36 takes 0.2 second (0.6 sec. − 0.2 sec. = 0.4 sec.).

Figure 8:
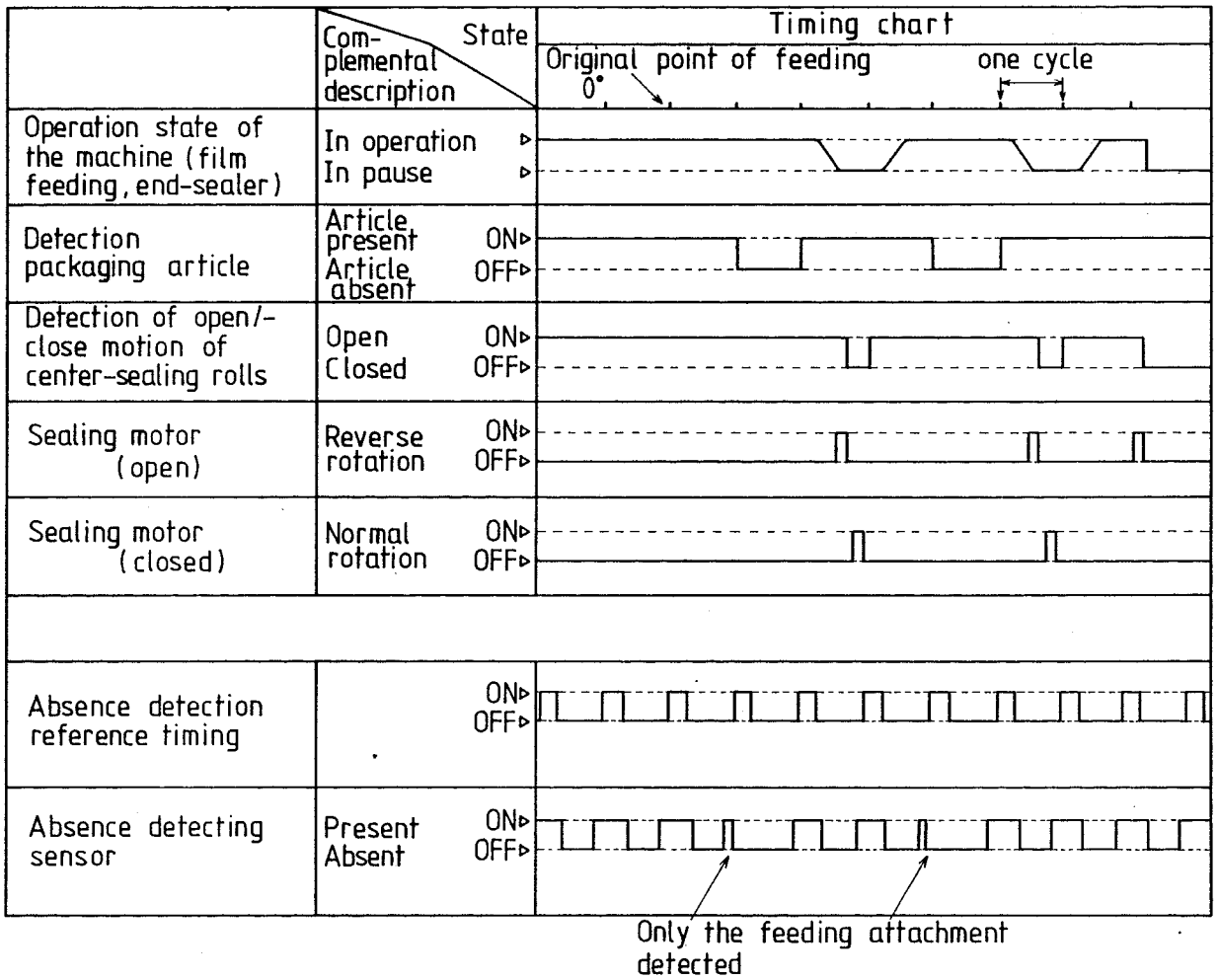
FIG. 8 is a timing chart illustrating the timing of each working member when the packaging machine is operated at a low rate of speed and wherein the absence of a packaging article has been detected twice.

Next, FIG. 8 shows a timing chart illustrating (1) the operational state of the motors B and C; (2) the operation of the motor for achieving the open/close movement of the sealing rolls 36; and (3) the relationship between the absence detection timing and the behavior of the absence detecting sensor 42, and the like, when an absence of a packaging article has been detected twice. Incidentally, while pulses are generated at a predetermined interval through means of an on/off operation so as to provide the absence detection timing, the absence detecting sensor 42 detects any absence of the packaging articles 10 forwarded by means of engagement with the respective attachments 14.

The above sensor 42 also detects movement of the attachment 14 itself upon the conveyor 12 so as to output a momentary pulse as shown in FIG. 8 when the attachment 14 passes thereby with no packaging article 10 engaged therewith. In this case, if the rising of the momentary pulse upon detection of the attachment 14 happens to coincide with the pulse of the absence detection timing, the above mentioned AND condition will be nullified in spite of the absence of the packaging article. Therefore, the absence detecting sensor 42 is designed to detect the attachment 14 at a position or time disassociated from the absence detection timing pulse.

Figure 9:
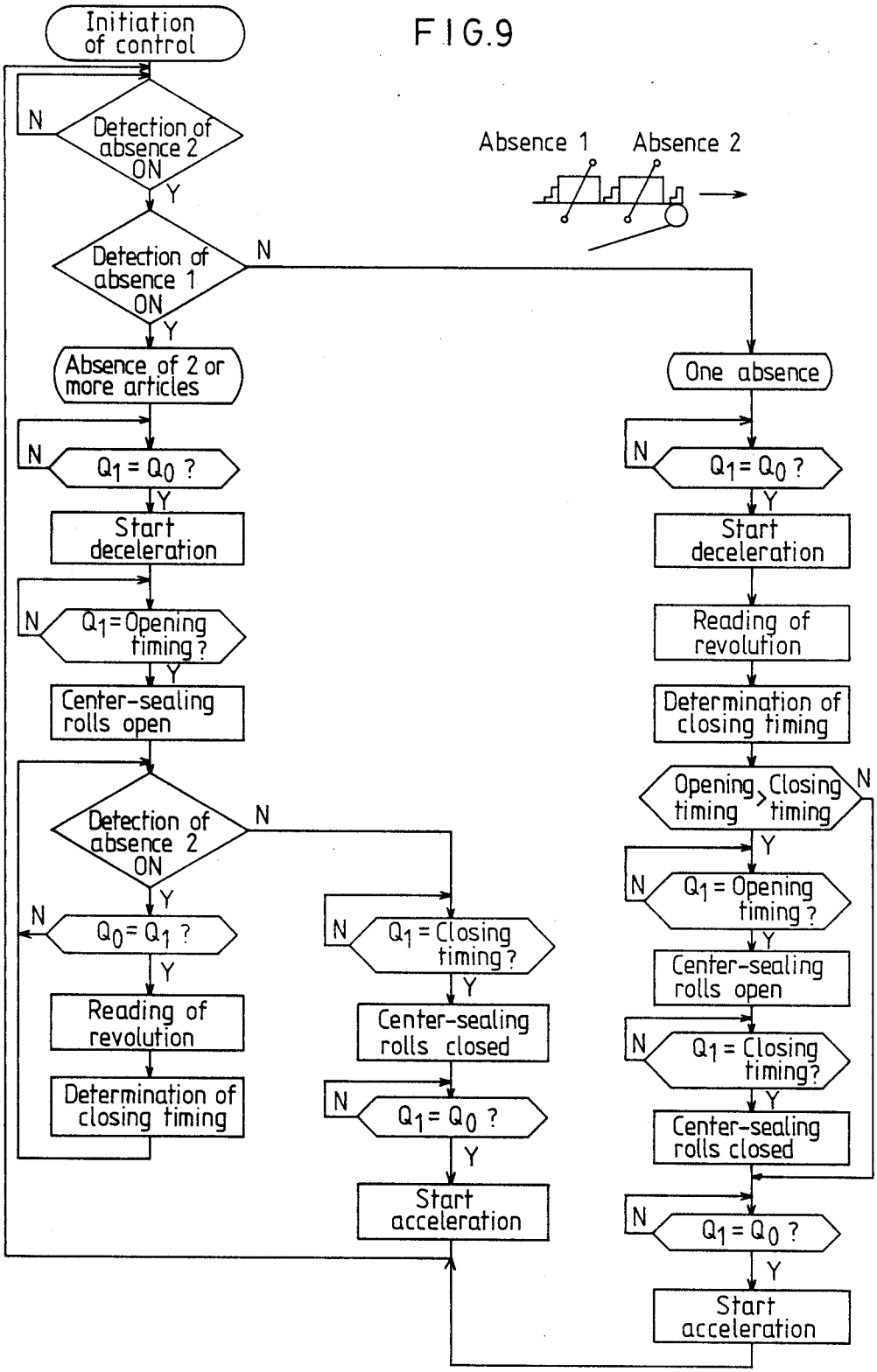
FIG. 9 is a flow chart illustrating the function of the vacant package-proofing control device constructed according to a preferred embodiment of this invention.

FIG. 9 shows a flow chart illustrating the function of the vacant package-proofing control device constructed according to the present embodiment. The above absence detecting sensor 42 detects the absence of a packaging article with respect to the attachment 14 passing the detection zone of the sensor in the present cycle and also during a subsequent cycle. In this chart, for the convenience of explanation, an example is shown where two sets of absence detecting sensors 42 are used. However, the number of sensors 42 to be employed may be one or two as necessary. The operational flow shown in this chart will be described below depending upon the case.

(In the case of the absence of one packaging article)

When the absence of a packaging article is detected only during the present cycle and not during the subsequent cycle, the flow line moves to the flow system shown on the right side of the chart. Namely, upon detection of an absence by one packaging article 10, the motors B and C begin their deceleration after waiting until the present location $Q_1$ to be known from the reference timing pulse generating means $S_1$ agrees with the cycle stop time $Q_o$. On the other hand, the reference timing pulse generating means $S_1$ senses the number of revolutions of the feed conveyor 12 so as to determine the timing of the closing of the sealing rolls 36. The determination of this closing time is achieved by calculating all of the times of the closing time $Q_c$ in terms of the rotation angle from the values of time Tc required for closing the rolls 36 and the revolutions N of the packaging machine.

For example, if the time Tc for closing the rolls is 0.2 second (Tc=0.2 sec.), and the revolutions N of the packaging machine is 60 rpm (N=60 rpm), the period for one cycle will be 1 second (t=1 sec.).

$\therefore Q_c = 360° \times (t - Tc/t)$

It can be seen that the closing time will be at the positions where the motors have advanced to 288° in terms of the rotation angle obtained from $360 \times (1 - 0.2/1)$.

Upon determination of the closing time $Q_c$, judgment is made if the opening time precedes the closing time based upon the cycle stop time $Q_o$. As described above referring to FIG. 3, when the packaging machine is operable at low speed, and the opening time precedes the closing time during one cycle starting from the original point of feeding, the rolls 36 are disengaged after waiting until the opening time agrees with the present location $Q_1$. Subsequently, closing of the sealing rolls 36 is started upon agreement of the closing time which is 0.2 second before the cycle stop time $Q_o$ (also the time for starting the two motors B and C) with the present location $Q_1$. The motors B and C are started under gradual acceleration conditions upon achievement of the present location $Q_1$=cycle stop time $Q_o$.

Incidentally, when it is judged that the closing time will be preceding the opening time, that is, when the packaging machine is operated at such a high rate of speed that the opening time will precede the closing time during one cycle starting from the original point of feeding, each of the above-mentioned open/close operations of the rolls 36 is entirely skipped and the motors B and C are started under their gradual acceleration conditions upon achievement of the present location $Q_1$=cycle stop time $Q_o$.

(In case of the absence of two packaging articles)

When the absence of a packaging article is detected both during the present cycle and during the subsequent cycle, by means of the absence detecting sensor 42, respectively, the sensor 42 memorizes the second absence and proceeds along the flow system continuing directly below the step of "absence of two or more articles". Upon agreement of the present location $Q_1$ to be known from the reference timing pulse generating means $S_1$ with the cycle stop time $Q_o$, deceleration of the motors B and C is started. After starting the deceleration of the motors B and C and after waiting until the present location $Q_1$ agrees with the opening time which has been calculated beforehand, that is, the time for stopping the motors B and C, the sealing rolls 36 are disengaged unconditionally.

Subsequently, the second absence memorized previously by means of the absence detecting sensor 42 is confirmed here (wherein in the case of the second or further absence, the flow line proceeds to YES), and then the reference timing pulse generating means $S_1$ reads the number of revolutions of the conveyor 12 after waiting until the present location $Q_1$ agrees with the cycle stop time $Q_o$. After calculation of the time for closing the sealing rolls 36, detection of an absence by means of the detecting sensor 42 is confirmed again.

If a third absence is not identified here, closing of the sealing rolls 36 is started upon agreement of the present location $Q_1$ with the closing time which have been calculated previously. Furthermore, upon agreement of the present location $Q_1$ with the cycle stop time $Q_o$, the motors B and C are started under gradual acceleration conditions.

Obviously, many modifications and variations of the present invention are possible in light of the above teachings. It is therefore to be understood that within the scope of the appended claims, the present invention may be practiced otherwise than as specifically described herein.

What is claimed is:

1. A vacant package-proofing control system for a packaging machine, comprising:

a first motor for driving a conveyor for feeding articles to be packaged with a predetermined space defined therebetween into a packaging material which is to be formed into a tube;

a second motor for driving a plurality of rolls which deliver said packaging material formed into said tube at a position disposed downstream of said conveyor;

a third motor for driving a pair of sealers for achieving end-sealing of said packaging material formed into said tube in a crosswise direction relative to the line of feed of said articles to be packaged;

an absence detecting sensor disposed at a predetermined position upstream of a location at which said articles to be packaged are transferred from said conveyor to said tubular packaging material for detecting any absence of a packaging article being transported upon said conveyor with a predetermined amount of space defined between said articles, and for generating a signal in response to detection of said absence of said packaging article;

reference timing pulse generating means for generating predetermined reference timing pulse signals with respect to said feeding of said packaging articles by said conveyor;

means for determining the coincidence of said absence detection signal from said absence detecting sensor and a reference timing pulse signal from said reference timing pulse generating means; and means for stopping said second motor for feeding said packaging material and said third motor for achieving said end-sealing of said packaging material under gradual deceleration conditions in response to a determination of said coincidence of said absence detection signal from said absence detecting sensor and a reference timing pulse signal from said reference timing pulse generating means by said coincidence determining means, and after a predetermined duration of time during which said second and third motors are stopped for a predetermined number of cycles corresponding to the number of absent packaging articles, for starting said second and third motors under gradual acceleration conditions until the speeds and phases of said second and third motors are synchronized with those of said first motor for driving said conveyor.

2. A vacant package-proofing control system for a packaging machine according to claim 1, further comprising:

means for stopping said pair of sealers at positions where they are free from contact with said packaging material when said third motor for achieving said end-sealing is stopped under said gradual deceleration conditions.

3. A vacant package-proofing control system for a packaging machine according to claim 1, further comprising:

a control means for stopping said pair of sealers for achieving said end-sealing of said packaging material at predetermined positions based upon the calculation of inputted data including the cut pitch for cutting said packaging material, and the height of said packaging article.

4. A vacant-package-proofing control system for packaging machine as set forth in claim 3, wherein said control means further comprises:

a control circuit for calculating a gradual acceleration/deceleration coefficient for said second and third motors for feeding said packaging material and for achieving said end-sealing of said packaging material whereby said second and third motors can be stopped and started under said gradual deceleration and acceleration conditions.

5. A vacant package-proofing control system for a packaging machine as set forth in claim 1, wherein:

absence detecting sensor comprises a photodetector.

6. A vacant package-proofing control system for a packaging machine as set forth in claim 1, wherein:

said coincidence determining means comprises an AND circuit.

7. A vacant package-proofing control system for a packaging machine as set forth in claim 1, wherein:

said reference timing pulse generating means comprises a rotary encoder.

8. A vacant package-proofing control device for a packaging machine, having:

a motor for driving anchor for feeding articles to be packaged with a predetermined space therebetween into a packaging material which is delivered downstream being formed into a tube;

a motor for driving a series of rolls which deliver downstream the packaging material into a tubular form;

a motor for driving a pair of sealers for achieving end-sealing of the packaging material formed into a tube in the crosswise direction relative to the line of feed; and a pair of sealing means disposed disengageably relative to said overlapped portions, for applying center-sealing to the overlapping longitudinal end portions of said packaging material formed into a tube when they are moved closer with each other, and further comprising:

a reference timing pulse generating means which generates predetermined reference timing pulses for the timing of feeding the packaging articles from said conveyor;

a means for starting with gradual acceleration the motor for feeding said packaging material and the motor for achieving end-sealing with gradual deceleration and for allowing said reference timing pulse generating means to read the number of revolution of said conveyor, followed by calculation of the sealing timing of said sealing means from the point where restarting of the motors and having made a stop with gradual deceleration and the time required for the sealing motions of said sealing means; and a means for judging which of the timing for spacing said sealing means based on the point of stopping the motor for feeding said packaging material and the motor of achieving end-sealing with gradual deceleration or the sealing timing calculated above precedes the other;

wherein said sealing means are designed to be spaced from each other based on the timing of stopping the motor for driving the rolls and the motor for driving the sealers as the spacing timing and subsequently moved closer to each other with a sealing timing obtained by calculating back the time required for the sealing motion of said sealing means based on the point where the motors B and C are started again when it is judged that the spacing timing precedes the sealing timing; whereas when it is judged that said sealing timing precedes said spacing timing, said sealing means are designed not to perform any spacing motion.

* * * * *